US005575085A

United States Patent [19]

Groombridge

[11] Patent Number: 5,575,085

[45] Date of Patent: Nov. 19, 1996

[54] APPARATUS AND METHOD FOR CONTROLLING THE ROTARY AIRLOCKS IN A COAL PROCESSING SYSTEM BY REVERSING THE MOTOR CURRENT ROTATING THE AIR LOCK

[75] Inventor: Clifton E. Groombridge, Hardin, Mont.

[73] Assignee: Western Syncoal Company, Billings, Mont.

[21] Appl. No.: 504,055

[22] Filed: Jul. 17, 1995

[51] Int. Cl.[6] ..... F26B 3/08

[52] U.S. Cl. ..... 34/368; 34/378; 34/386; 34/482; 34/525; 34/572; 34/573; 34/593; 318/280; 110/101 C; 417/44.11

[58] Field of Search ..... 34/531, 413, 92, 34/354, 368, 378, 386, 447, 482, 524, 562, 572, 573, 586, 593, 85; 318/283, 280, 285, 432, 434; 110/105, 106, 101 C, 186; 44/621, 622, 623, 624, 625, 626; 417/44.11, 45

[56] References Cited

U.S. PATENT DOCUMENTS

| | | | |
|---|---|---|---|
| 2,636,642 | 4/1953 | Gorin | 34/576 X |
| 3,619,908 | 11/1971 | Kallas | 34/573 |
| 3,841,793 | 10/1974 | MacManus | 417/45 |
| 4,030,878 | 6/1977 | Kunath | 34/527 X |
| 4,076,150 | 2/1978 | Didrickson | 222/368 |
| 4,183,705 | 1/1980 | Kice | 414/221 |
| 4,237,619 | 12/1980 | Ledding | 34/57 R |
| 4,238,058 | 12/1980 | Heth | 222/368 |
| 4,266,348 | 5/1981 | Ledding | 34/10 |
| 4,599,809 | 7/1986 | Parkes | 34/31 |
| 4,750,273 | 6/1988 | Parkes et al. | 34/30 |
| 4,782,741 | 11/1988 | Sigmon | 92/261 |
| 4,910,443 | 3/1990 | Zylstra et al. | 318/285 X |
| 5,029,517 | 7/1991 | Sigmon | 92/261 |
| 5,122,259 | 6/1992 | Nielson | 208/407 |
| 5,122,716 | 6/1992 | Kashihara et al. | 318/280 |
| 5,165,434 | 11/1992 | Tobiason | 134/113 |
| 5,178,733 | 1/1993 | Nielson | 202/84 |
| 5,180,407 | 1/1993 | DeMarco | 55/302 |
| 5,233,932 | 8/1993 | Robertson | 110/186 X |

*Primary Examiner*—John M. Sollecito
*Assistant Examiner*—Steve Gravini
*Attorney, Agent, or Firm*—Leonard Bloom

[57] ABSTRACT

An improvement to a coal processing system where hard materials found in the coal may cause jamming of either inflow or outflow rotary airlocks, each driven by a reversible motor. The instantaneous current used by the motor is continually monitored and compared to a predetermined value. If an overcurrent condition occurs, indicating a jamming of the airlock, a controller means starts a "soft" reverse rotation of the motor thereby clearing the jamming. Three patterns of the motor reversal are provided.

31 Claims, 10 Drawing Sheets

APPARATUS AND METHOD FOR CONTROLLING THE ROTARY AIRLOCKS IN A COAL PROCESSING SYSTEM BY REVERSING THE MOTOR CURRENT ROTATING THE AIR LOCK

The Government of the United States of America has certain rights in this invention pursuant to contract No. DE-FC22-90PC89664 awarded by the U.S. Department of Energy.

FIELD OF THE INVENTION

The present invention relates to a coal processing system, and more particularly, to improvements preventing the jamming of rotary airlocks in a coal processing system.

BACKGROUND OF THE INVENTION

Certain geographical areas have large deposits of coal. However, the coal may be low-rank coal requiring a beneficiation, namely, to remove moisture and impurities and thus improve the BTU to weight ratio; and for this reason, the coal is treated in coal processing systems. In these systems, the coal is conveyed into (and out of) a pressure chamber having a controlled gaseous composition, wherein the coal is subjected to increased temperatures and pressures.

Rotary airlocks are an important part of the coal processing system 10 (as shown in FIG. 1). These rotary airlocks 11 and 11' are installed at the entrance and exit, respectively, of the pressure chamber (or fluidized bed) 12 for transferring the coal between successive processing operations, maintaining the pressure and temperature differential therebetween, and keeping gaseous compositions within the pressure chamber 12 and may include the airlock 11' with controlled feed rate and the free flow airlocks 11. Thus, the rotary airlocks are a major, and important, components in coal processing systems.

Unfortunately, however, the conventional rotary airlocks currently being used (in coal processing systems) tend to jam. The jamming is caused by hard materials found in the coal being processed, as for example, lumps of solid rocks which become stuck between the rotating vanes and the stationary walls of the rotary airlocks. When jamming occurs, the entire continuous coal processing system must be stopped in order to clear or unclog the jammed airlock. As somewhat schematically shown in FIG. 2, cleaning of the jammed airlock usually is a manual, time consuming and expensive operation; and permanent damage to the rotary airlock and its motor and drive systems may occur.

Although the prior art of rotary airlocks is well developed, nevertheless, all of these prior art rotary airlocks are subject to jamming or clogging.

For instance, U.S. Pat. No. 4,076,150 describes a rotary airlock with blades adjustable in such a manner so as to maintain the pressure seal. U.S. Pat. Nos. 4,750,273, 4,599,809 and 5,165,434 describe rotary airlocks powered by an electric motor (schematically shown in FIG. 3). U.S. Pat. Nos. 5,122,259 and 5,178,733 teach a rotary airlock with means for indicating and controlling the speed of rotation. However, none of these prior art patent references is concerned with preventing jammings of the airlocks.

In an effort to solve this problem, mechanical sensors have been suggested in the field to detect jams and, once detected, mechanical switches provide for a reverse rotation to clean the rotary airlock. Disadvantageously, the mechanical switches are unable to quickly sense jams and to take corrective actions in order to adequately prevent solid jams.

Therefore, a more reliable and less expensive means for quickly detecting when a rotary airlock (in a coal processing system) may jam, and for quickly preventing the jam and unclogging the rotary airlock, would be very desirable.

SUMMARY OF THE INVENTION

It is, therefore, an object of the present invention to provide a coal processing system having improved control of its rotary airlocks, thereby avoiding costly shut-downs of the overall system.

It is a further object of the present invention to provide a coal processing system, wherein the rotary airlocks are continually monitored for sensing even a partial jamming; and wherein the direction of rotation of the vanes in the rotary airlocks is quickly reversed, thereby clearing a partial jamming and avoiding a complete (or solid) jamming.

It is still another object of the present invention to provide a coal processing system having a means for continually monitoring the instantaneous current of a motor and drive system which rotates the vanes of the airlock, and further having a controller for reversing the motor when the instantaneous motor current exceeds a predetermined value.

Although the present invention may find an application in any material processing apparatus requiring rotary airlocks when handing any abrasive, granular, powdered material, crushed ore, etc., it finds its particular utility in a coal processing system, wherein coal particles are passed into and out of a processing vessel through inflow and outflow rotary airlocks, each of which includes a plurality of circumferentially-spaced vanes rotating within a chamber and mounted on a shaft driven by a variable-speed reversible electric motor externally of the chamber (the motor having a rated operating current) and wherein each of the rotary airlocks is subject to jamming by lumps of solid rock or other hard materials found in the coal.

In accordance with the teachings of present invention, the improved coal processing system includes a means for continually monitoring the instantaneous current of the motor driving the rotary airlock. The instantaneous motor current is compared to the rated operating current of the motor to obtain a differential signal; and a controller means reverses the motor when the differential signal has exceeded a predetermined threshold value. As a result, even a partial jamming in the rotary airlock is quickly sensed, the rotary airlock is quickly cleared, and complete jams and costly shut-downs of the overall system are avoided.

In a preferred embodiment, the quick clearing may be performed according to one of the following methods:

a. The controller means reverses the original direction of the rotation of the vanes of the rotary airlock and continues this reversed direction until the next jamming situation occurs.

b. The controller means reverses the original direction of rotation of the vanes of the rotary airlock for a short time, and then continues the rotation in its original direction.

c. The controller means reverses the original direction of rotation of the vanes of the airlock several times in momentary succession, and then continues the rotation in its original direction.

Preferably, the controller means provides a "soft" start for reversing the motor.

These and other objects of the present invention will become apparent from a reading of the following specification, taken in conjunction with the enclosed drawings.

DETAILED DESCRIPTION OF THE PREFERRED EMBODIMENT

Figure 1:
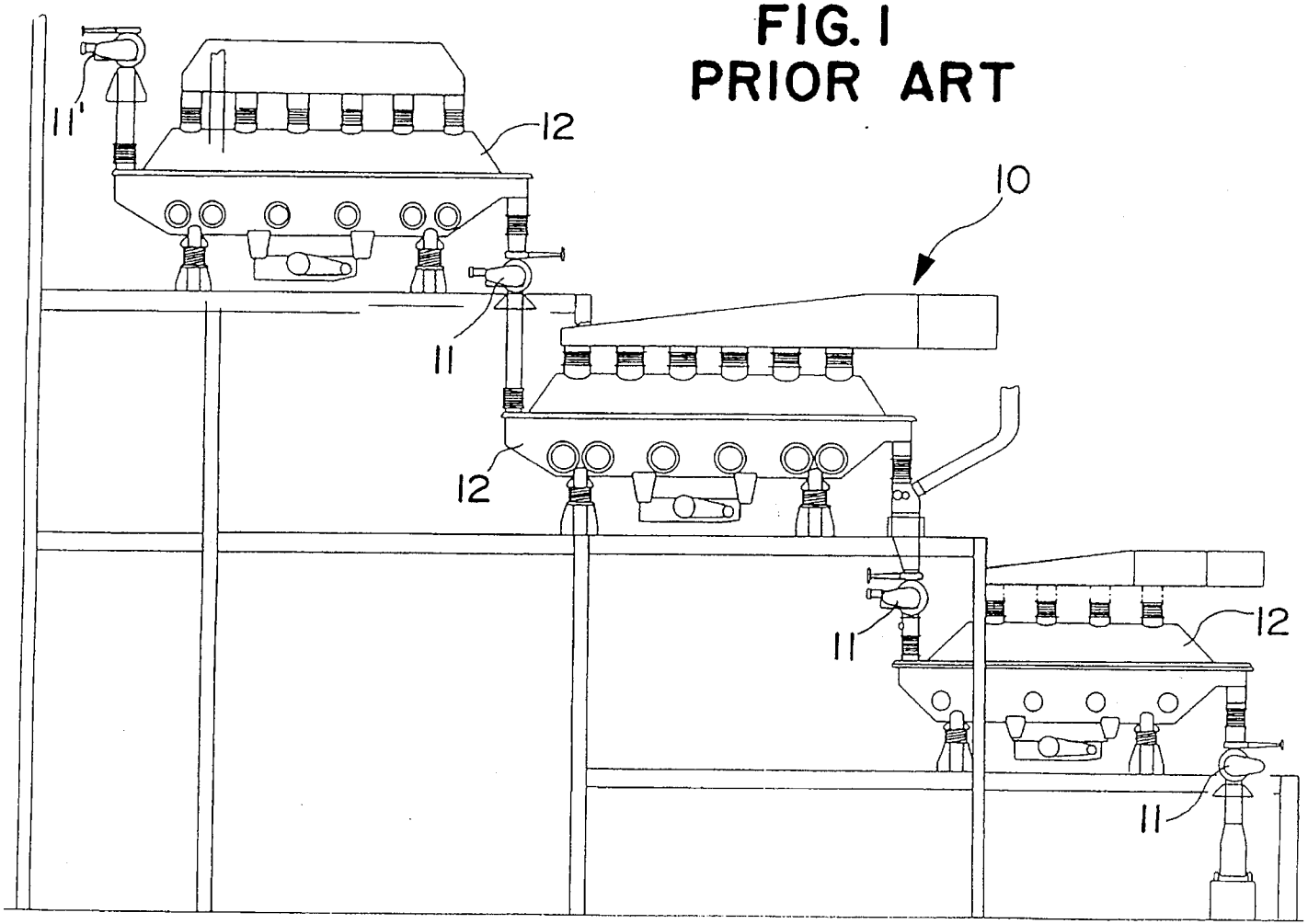
FIG. 1 PRIOR ART
FIG. 1 is a schematic view of a coal processing system showing the relative location of rotary airlocks in the thermal and cooling process according to the prior art.
Figure 2:
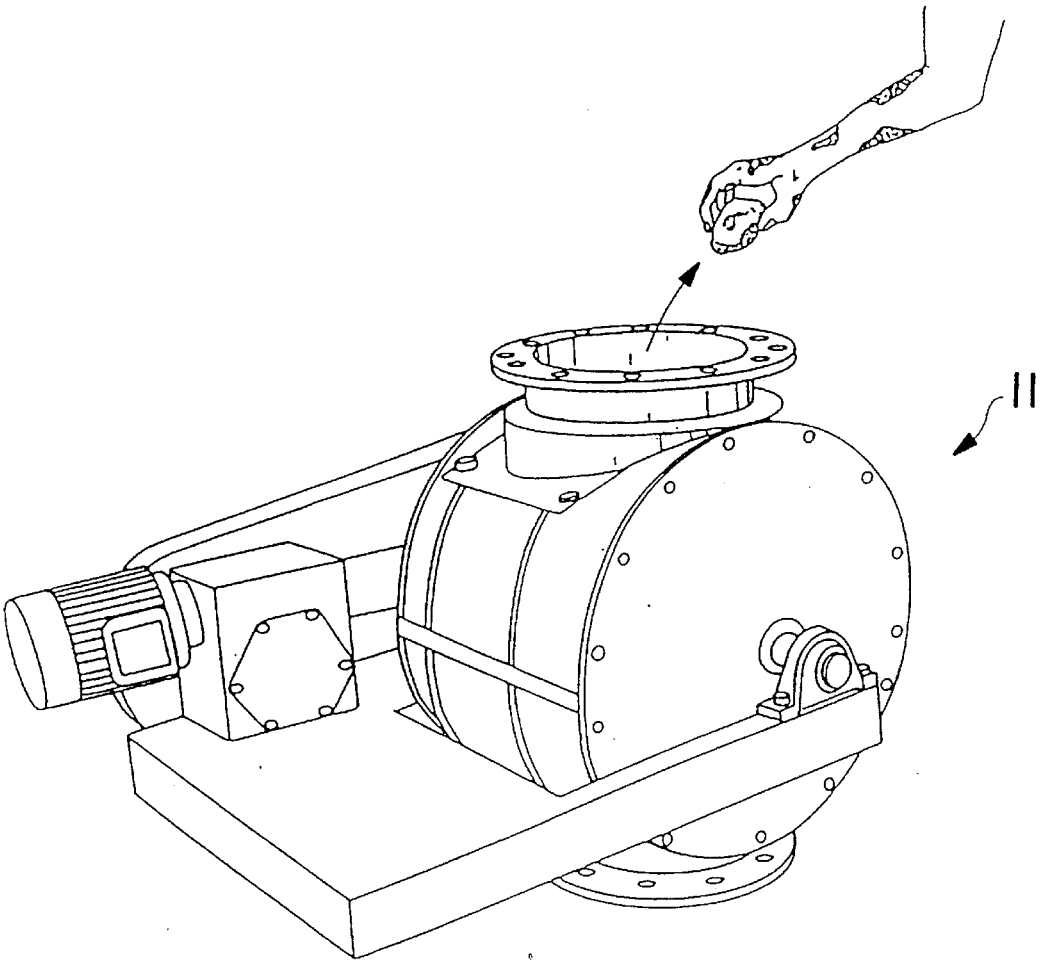
FIG. 2 PRIOR ART
FIG. 2 shows a manual cleaning of the jammed airlock, according to the prior art.
Figure 3:
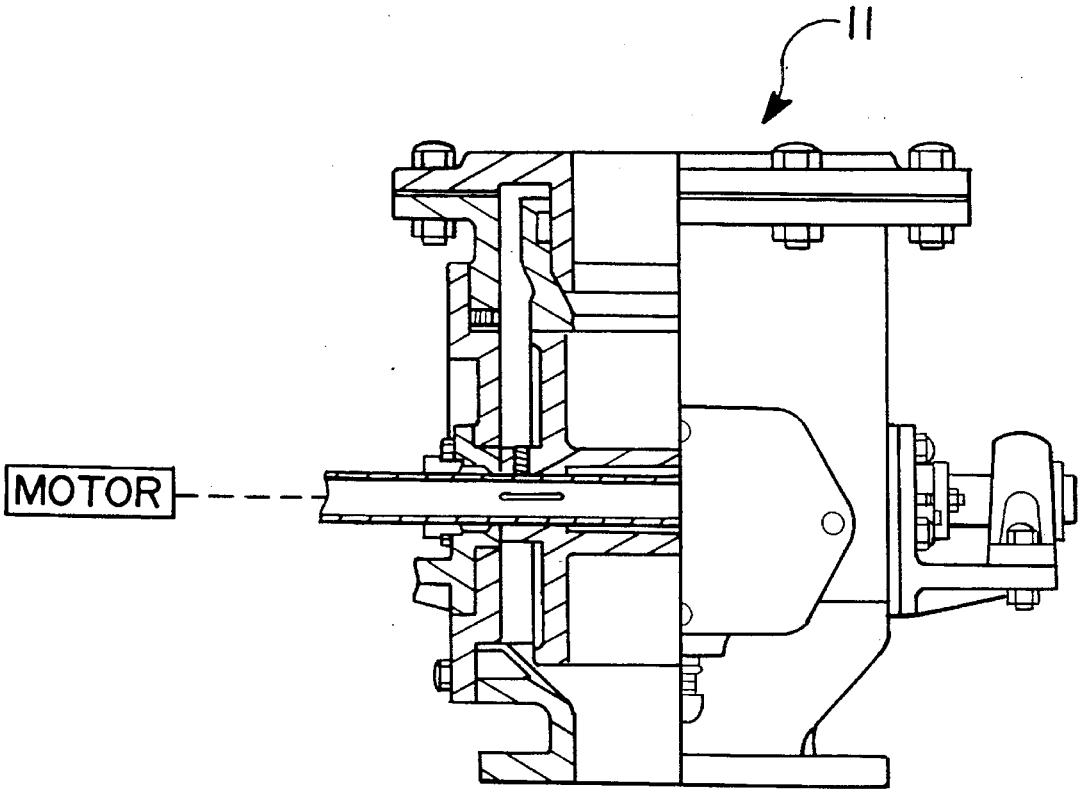
FIG. 3 PRIOR ART
FIG. 3 is a side elevational view of a rotary airlock of the prior art with certain parts broken away and sectioned.

Referring to FIGS. 4–6 and 7A–7D, an airlock 13 includes a cylindrical housing 15, a shaft 16 extending therethrough, and a plurality of circumferentially-spaced vanes 17 mounted on a first portion 16' of the shaft 16 and secured thereon. The vanes 17 have respective working edges which desirably have a minimum clearance relative to the housing 15. Alternately, a blade may be secured to the vane 17 and extend outwardly therefrom to provide minimum clearance relative to the housing 15. An inlet 18 and outlet 19 communicate with a chamber 20 defined by the housing 15. The inlet 18 carries the coal 14 into the chamber 20, and the outlet 19 carries the coal away from the chamber 20. An electric motor 21 is located outside of the housing 15 in electrical and mechanical contact with a second portion 16" of the shaft 16 extending outwardly of the housing 15.

Figure 7A:
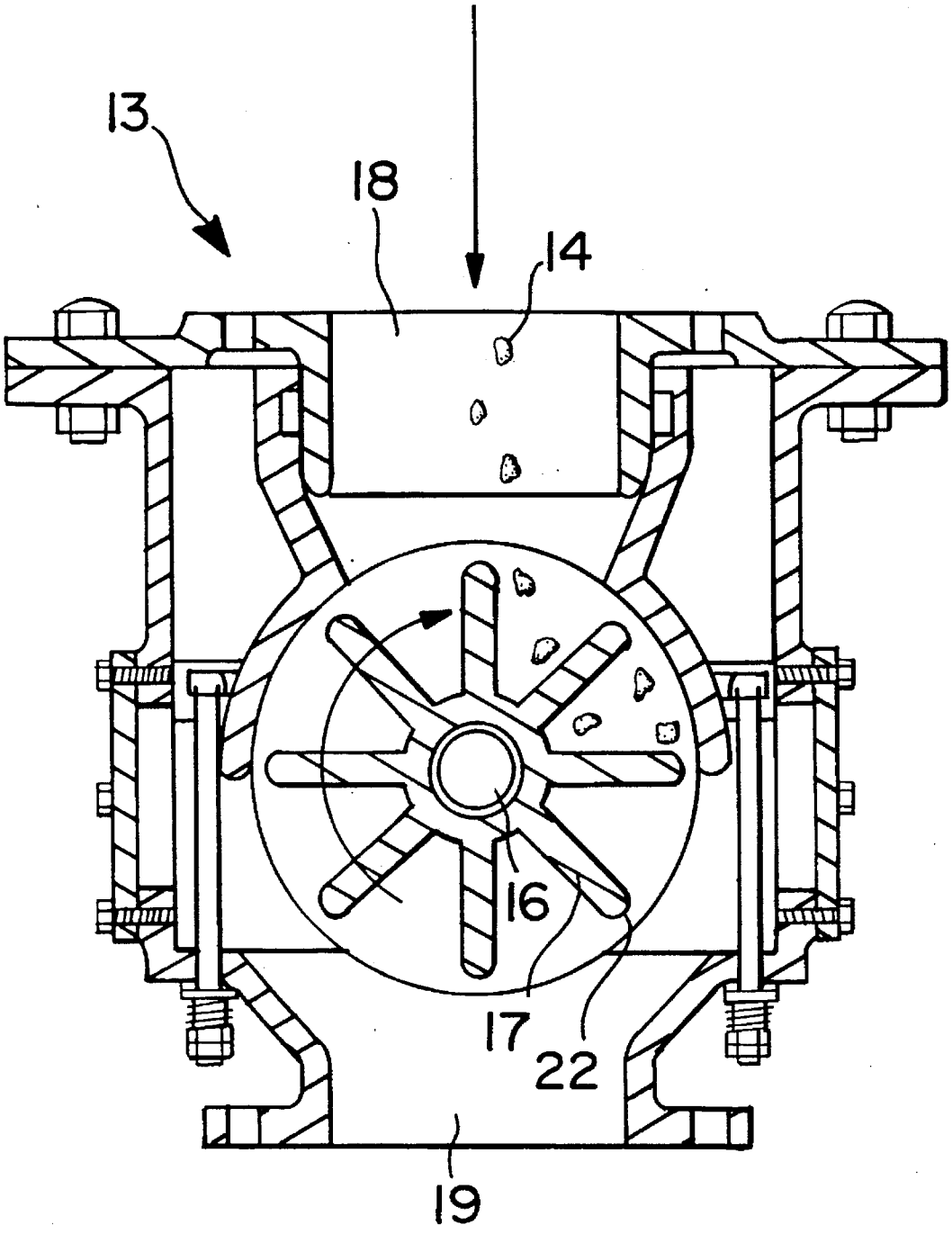
FIGS. 7A–7D show schematically (in cross-section of the airlock of the present invention) steps of forming the jamming situation and automatic "unjamming" of the airlock.
Figure 7B:
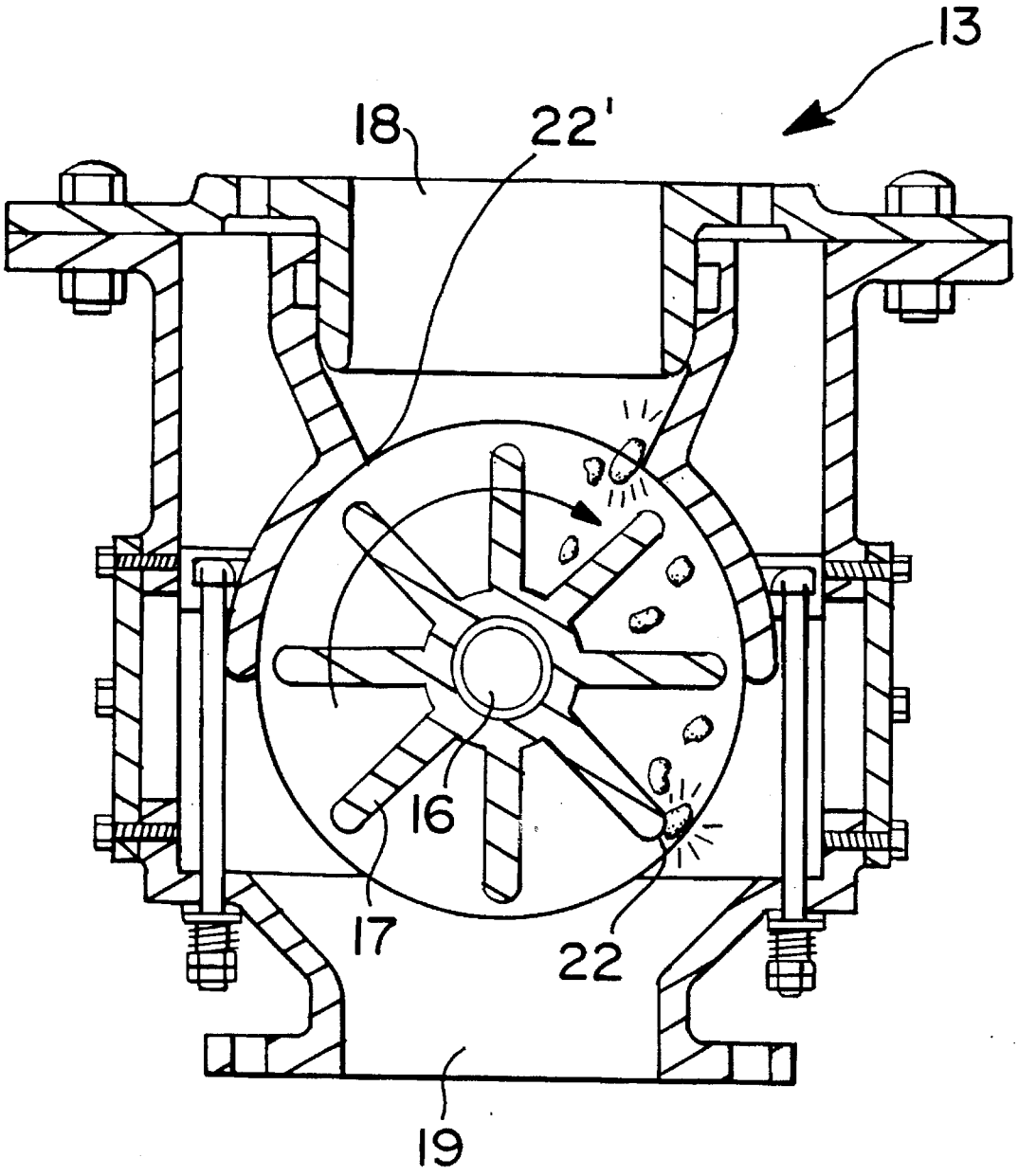

Some clearance 22 is provided between working edges 23 of the vanes 17 and interior walls 24 of the chamber 20 to allow for rotation of the shaft 16 and the vanes 17. The clearance 22 has a tendency for jamming by hard materials, for instance, lumps of solid rock, found in the coal stock. Most common is jam occurring at the pinch point 22' where the vane 17 comes into close proximity with the sealing surface created by the housing 15. Furthermore, multiple pockets which are defined between the shaft 16, housing 15 and adjacent vanes 17, also may cause jamming of the airlock 13 by hard materials, as best shown in FIGS. 7A and 7B.

It is important to correct the undesirable jamming at its initial stage before a complete jam has been developed. Since the complete jam may be developed from a partial jam relatively fast, it is important to sense the partial jam substantially immediately. It was found that anything longer than a very short delay after jamming of the airlock occurred would in-turn cause lock-up internally to right-angle gear reducer 34 that transmits power from the electric motor 21 to the shaft 16 of the rotary airlock. The lock-up of the right-angle gear reducer 34, if happens, requires removal of the chain that connects the drive motor to the gear reducer 34 to correct the problem.

Figure 4:
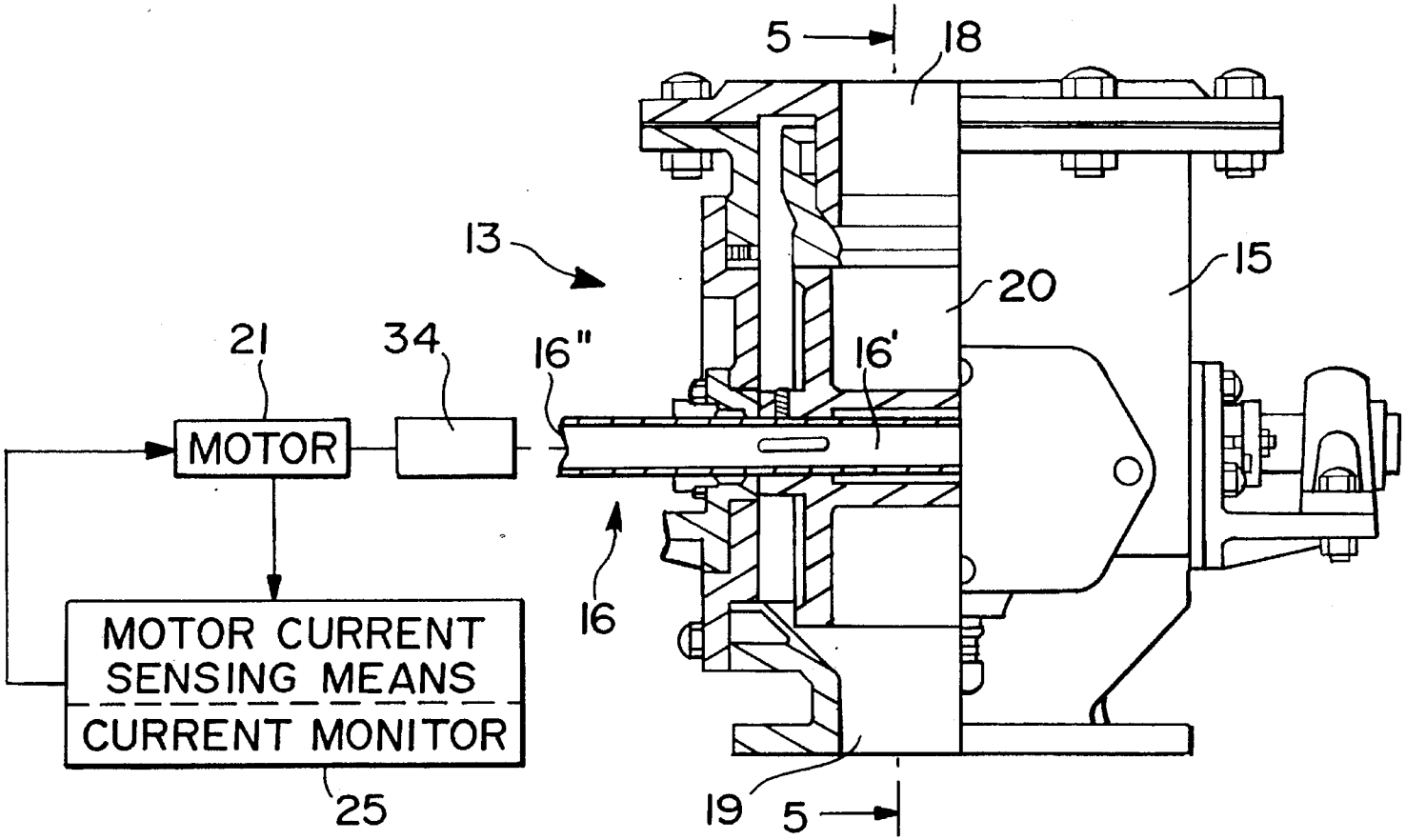
FIG. 4 is a side elevational view of a rotary airlock of the present invention corresponding substantially to FIG. 3, but showing schematically a motor with a motor current sensing means.
Figure 5:
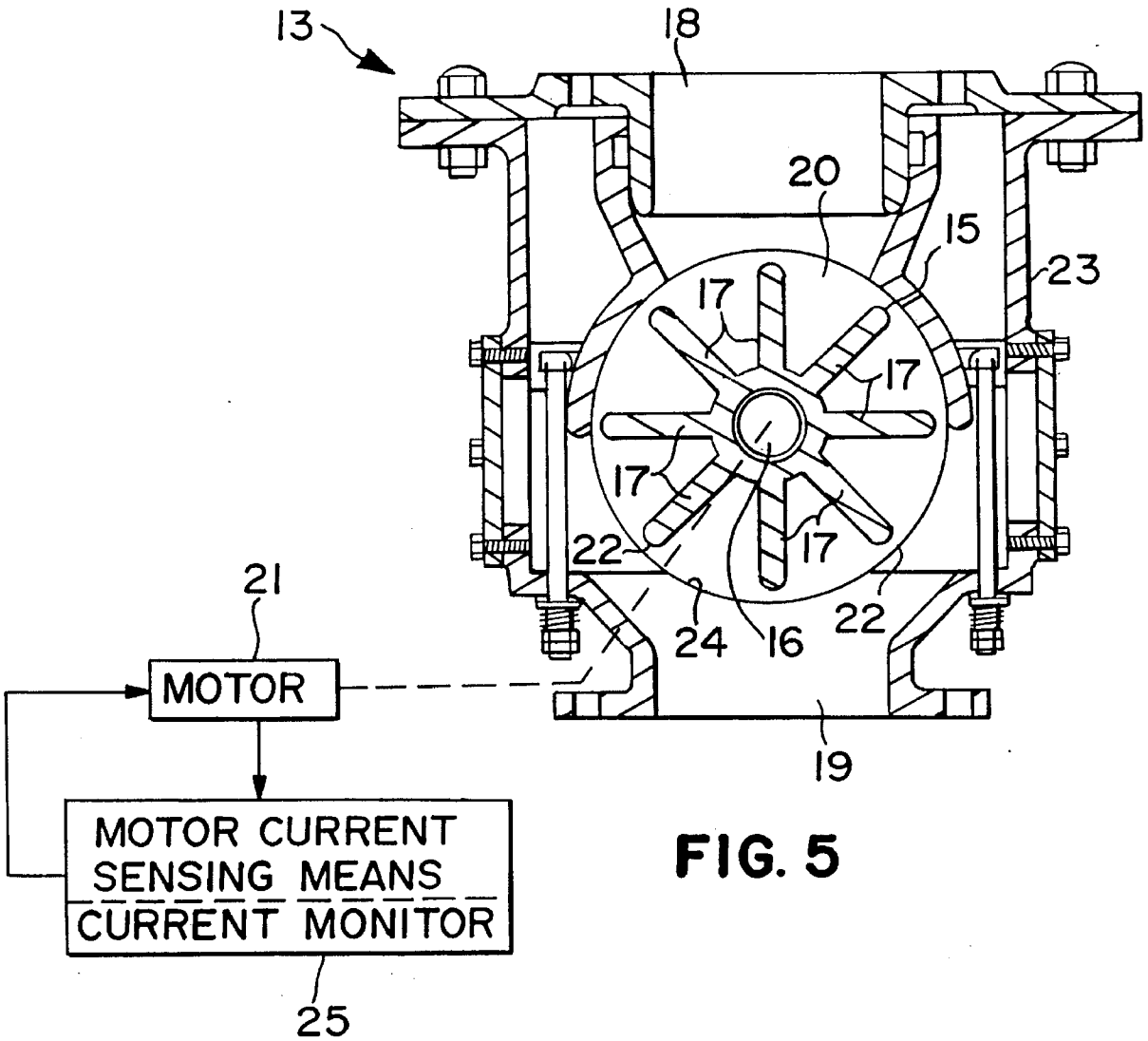
FIG. 5 is a cross-section of the rotary airlock of FIG. 4 taken along lines 5—5 thereof.
Figure 6:
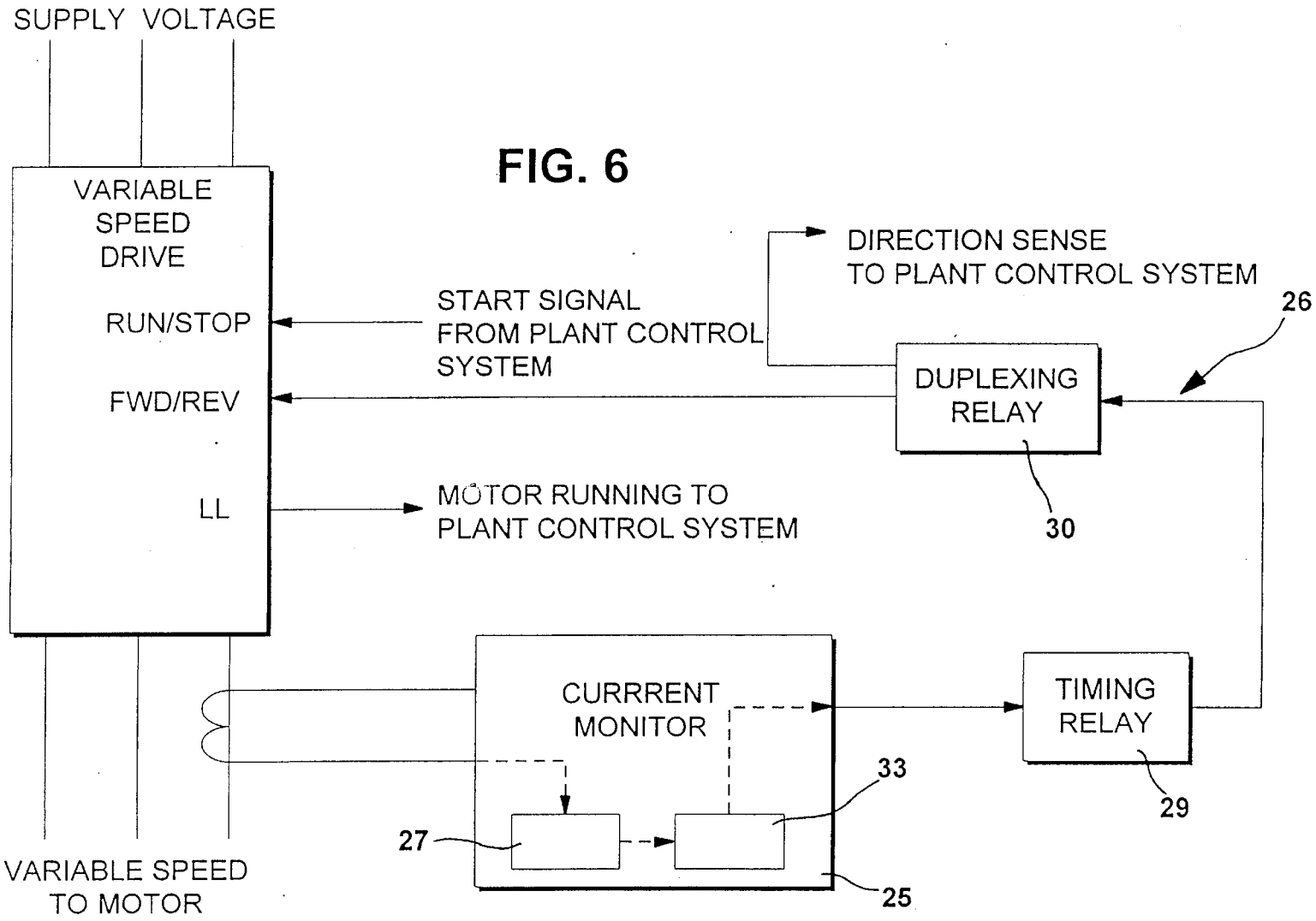
FIG. 6 is a block-diagram of the motor control sensing means of the rotary airlock used in the coal processing system of the present invention.

For this reason, the motor 21 is provided with a current monitor 25 for continually monitoring current used by the motor, as best shown in FIGS. 4–6. Since motor current is directly proportional with motor torque, even partial jams cause a substantial and immediate increase in the current to be drawn by the motor 21. The essential feature of the present invention—the monitoring of the instantaneous motor current—provides a higher sensitivity of the current monitor 25 to partial jams. This reduces the number of complete jams that need to be corrected, by correcting them in the initial (partial) jam stages.

Figure 7C:
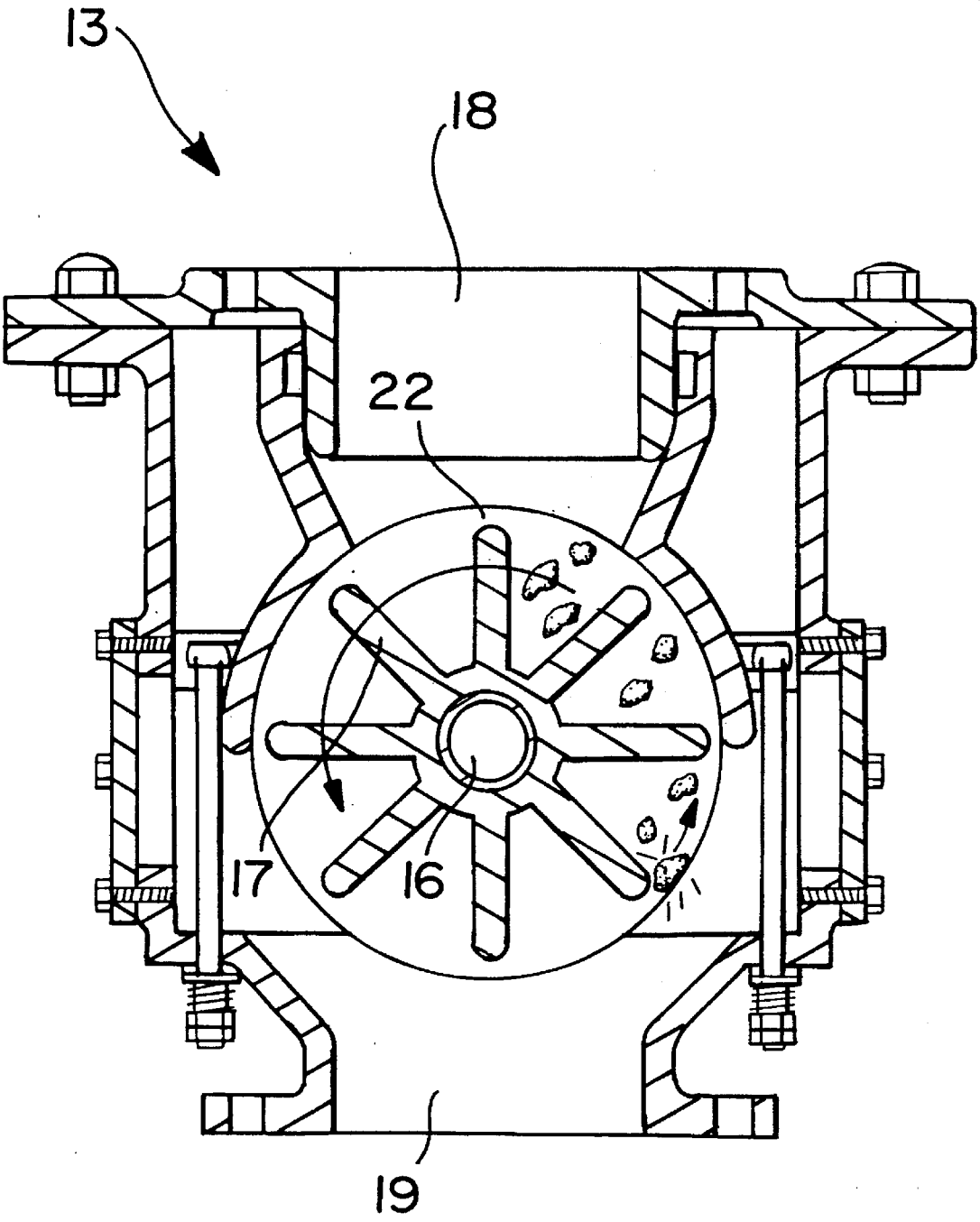
Figure 7D:
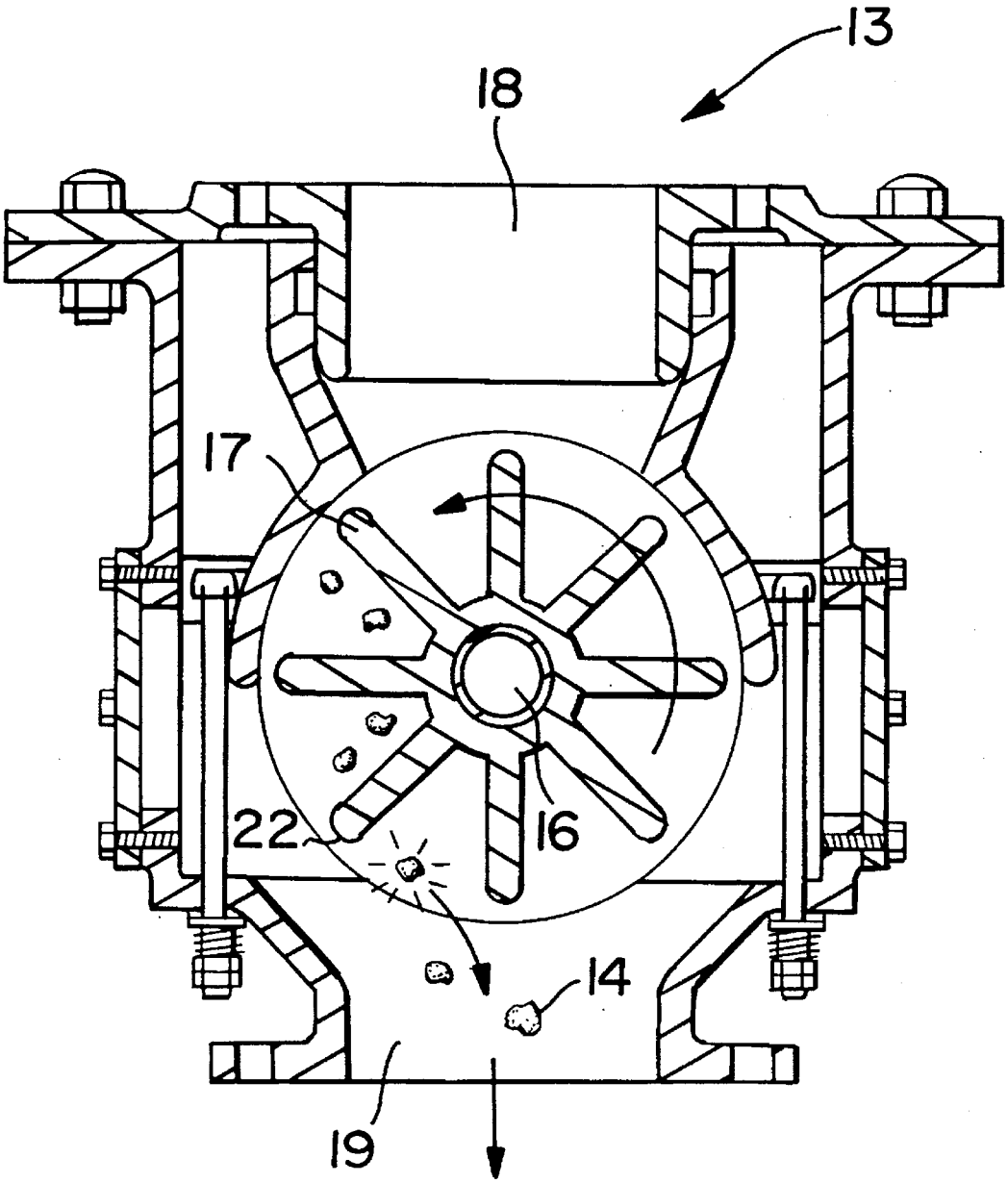

Once the current monitor 25 detects the increasing current drawn by the motor 21, indicating thereby a partial jam of the airlock 13, a controller 26 automatically reverses rotation of the motor 21, thereby reversing rotation of the shaft 16 and vanes 17. This automatic action unjams the airlock 13 before the complete jam matures out of the partial jam, as best shown in FIGS. 7C and 7D.

As best shown in FIG. 6, the controller 26 includes a timing relay 29 and a duplexing relay 30 and operates as follows:

the variable speed drive receives a run command from the plant control system (typically a programmable logic controller). The current monitor 25, and particularly the current sensor 24, which is an integral part of the current monitor 25, monitors one of the motor leads 28 and compares the current to an adjustable set point (typically set between 125% and 150% of motor full load current) by a comparing means 33 which is also an integral part of the current monitor 25. While the motor current reaches or exceeds the set point, a signal is applied to a timing relay 29. If the signal is applied to the timing relay 29 for a period greater than tis adjusted value (typically 0.5 seconds), a signal is applied to the duplexing relay 30. The duplexing relay 30 then switches the direction signal to the variable speed drive. The variable speed drive will then decelerate and then accelerate in the new direction. The motor status signal is fed back to the plant control system to provide verification of selected motor state (run or stop). Contacts of the duplexing relay 30 are monitored by the plant control system in order to detect and notify the operator upon the initiation of a direction change. Monitoring the duplexing relay 30 with the plant control system also provides shutdown of the motor 21 in the event of a jam that does not clear (detected upon occurrence of a rapid succession of direction changes). The above variable speed drive can be replaced with a reversing motor starter (preferably a soft starting type) for airlock applications that are not used for controlling feed rate.

It will be appreciated by those skilled in the art that the motor will draw a certain level of current when it is free running and not jammed at all. When the airlock is completely jammed, and the vanes are not rotating at all, the motor 21 will draw a substantially higher level of current. It is effective to take automatic unjamming action when the current drawn by the motor has risen to a level equal to or greater than the average between free running current level and the completely jammed current level, thereby indicating a partial jam existing and the threat of a complete (or solid) jam developing.

For example, if the normal current reading for a particular airlock with a particular motor (in a given application) is two (2.0) amps in the unjammed free-running condition, then a reading of three point five (3.5) amps or higher may indicate a partial jam, and a reading of five (5) amps may indicate a complete jam.

In this particular example, an instantaneous current of the motor is continually compared with a rated operating current (2.0 amps) of the motor to obtain a differential signal. If the differential signal exceeds a predetermined threshold value (1.5 amps) indicating a partial jam, then the motor is reversed in one of three operating patterns discussed herein to clear the jamming occurred. As best shown in FIGS. 7C and 7D, after reversing the motor, the obstruction falls further into the pocket between airlock vanes (blades) 17, so that it clears the jam.

It will be appreciated by those skilled in the art that the example discussed herein is intended for illustration purposes only, and a variety of other current readings as well as predetermined threshold values for each particular coal processing system are possible.

Another essential feature of the invention is that the controller 26 takes advantage of the variable speed capabilities of the motor 21, and controls these capabilities in order to provide a "soft" start for reversing the motor by ramping up the power supplied to the motor 21 from zero to the final operating level. This allows the motor 21 to accelerate to its final operating speed over a relatively short period of time. If the power is supplied to the motor 21 abruptly (and not ramped up, as in the present invention) the motor 21 would have a "hard" start resulting in increased stresses in the motor 21 and the airlock 13. Accordingly, the "soft" start of the motor 21 in the present invention reduces wear, as well as the time consuming and expensive maintenance on the coal processing system.

The following three methods (or "strategies") of cleaning jams (partial or complete) can be provided by the controller 26 upon a reading of the motor current increase:

1. For an airlock capable of rotating in either direction, a simple reversal of the direction of the rotation. For example, in an airlock application where the airlock has a top inlet and a bottom outlet, the vanes can usually rotate in either direction without operational impact on the plant.
2. For an airlock which may need to rotate in only one direction, a reversal of the direction of rotation for only a short period of time, and then automatically returning the airlock to forward (or original) rotation.
3. Reversal of the direction of rotation several times in quick succession, in order to unjam in a rocking type of motion, and then return the airlock to the proper permanent (or original) direction of rotation.

Obviously, many modifications may be made without departing from the basic spirit of the present invention.

For example, at least two different configurations for reversing the airlocks upon sensing a jam may be used, both configurations using motor current to detect the jam. The major difference between the two configurations is that a reversing motor starter (rather than a variable frequency drive) is used for airlock applications that free-flow material through the airlock. The variable frequency (speed) drive is used with applications that control a feed rate.

The present invention can be manufactured and used for any size rotary airlock. With different sizes of airlocks and motors, different current readings would be used to indicate partial jams and complete jams, and to undertake unjamming strategies. Different applications for the same size airlock with the same size motor may also require different triggering current readings, and this can be established by empirical observation in each case.

Accordingly, it will be appreciated by those skilled in the art that within the scope of one appended claims, the present invention may be practiced other than has been specifically described herein.

What is claimed is:

1. In a coal processing system, wherein coal particles are passed into and out of a processing vessel through a rotary airlock, the rotary airlock including a plurality of circumferentially-spaced vanes rotating within a chamber in an original direction and mounted on a shaft driven by a reversible electric motor externally of the chamber, the motor having a rated operating current, and wherein the rotary airlock is subject to jamming by lumps of solid rock or other hard materials found in the coal, thereby requiring a complete shut-down of the system to manually unclog the rotary airlock, the improvement which comprises means for continually monitoring the instantaneous motor current, means for comparing the instantaneous motor current to the rated operating current of the motor to obtain a differential signal, and controller means for reversing the motor when the differential signal has exceeded a predetermined threshold value, thereby quickly sensing when jamming may occur in the rotary airlock, and thereby quickly clearing the rotary airlock and avoiding costly shut-downs in the system.

2. The improvement of claim 1, wherein the controller means reverses the motor substantially immediately once the differential signal has exceeded the predetermined threshold value, thereby unjamming initial stages of a complete jam and avoiding the complete jam.

3. The improvement of claim 1, wherein the controller means triggers the motor to reverse the motor repeatedly until the rotary airlock is cleared of the jam.

4. The improvement of claim 1, wherein the motor has a variable speed capabilities, and wherein the controller means controls the variable speed capabilities to provide a soft start for reversing the motor.

5. The improvement of claim 4, wherein the controller means ramps up power to the motor from substantially zero to a final operating level in order to provide a soft start for reversing the motor.

6. The improvement of claim 1, further including a quick response current switching means.

7. The improvement of claim 1, wherein the controller means reverses the motor automatically.

8. The improvement of claim 1, wherein the controller means reverses the original direction of rotation of the vanes and keeps a reversed direction until next jamming situation occurs.

9. The improvement of claim 1, wherein the controller means reverses the original direction of rotation of the vanes for a short time, and then continues the rotation of the vanes in the original direction.

10. The improvement of claim 1, wherein the controller means reverses the original direction of rotation of the vanes several times in momentary succession, and then continues the rotation of the vanes in the original direction.

11. The improvement of claim 8, wherein the predetermined corresponding threshold value comprises an average of a current value corresponding to an unjammed rotary airlock and a current value corresponding to a completely jammed airlock.

12. In combination with a coal processing system, wherein coal particles are transported into and out of a processing vessel through an inflow and outflow substantially identical rotary airlocks, respectively, the inflow and outflow rotary airlocks each being driven by a corresponding reversible electric motor, and wherein each of the inflow and outflow rotary airlocks is subject to jamming by hard materials found in the coal, an improvement to each of the inflow and outflow rotary airlocks, comprising:

means for continually monitoring an instantaneous motor current, and controller means electrically communicating with the motor and automatically reversing the motor when the monitored instantaneous motor current exceeds a predetermined current value, thereby substantially immediately sensing an initial stage of the jamming and quickly clearing the rotary airlock.

13. The improvement of claim 12, wherein the controller means keeps a reversed direction of rotation of the motor until next jamming occurs.

14. The improvement of claim 12, wherein the controller means reverses the original direction of rotation of the motor for a short time, and then continues the rotation of the motor in the original direction.

15. The improvement of claim 12, wherein the controller means reverses direction of rotation of the motor several times in momentary succession, and then continues the rotation of the motor in the original direction.

16. The improvement of claim 12, wherein the motor is a variable speed motor, and wherein the controller means controls the motor to provide a soft start for reversing the motor.

17. The improvement of claim 16, wherein the controller means ramps up power to the motor from substantially zero to a final operating level in order to provide a soft start for reversing the motor.

18. The improvement of claim 12, wherein at least one of the inflow and outflow airlocks contains a housing having a cylindrical chamber with an inlet and an outlet, and wherein the inlet and outlet of the chamber of at least one of said inflow and outflow airlocks are disposed vertically.

19. The improvement of claim 12, wherein at least one of said inflow and outflow airlocks includes a cylindrical chamber with an inlet and outlet, and wherein the inlet and the outlet of the chamber are disposed horizontally.

20. The improvement of claim 12, wherein the predetermined current value of the motor comprises an average of a current value when the rotary airlock is unjammed and a current value when the rotary airlock is completely jammed and cannot rotate.

21. In combination with a coal processing system, wherein coal particles are transported into and out of a processing vessel through an inflow and outflow substantially identical rotary airlocks, respectively, the rotary airlocks being driven by a reversible electric motor, the rotary airlocks each comprising:

a housing containing a cylindrical chamber with an inlet and an outlet, a shaft having a first portion, accommodated within the chamber coaxially to a central axis of the chamber, and a second portion extending outside the chamber and attached to the motor, a plurality of circumferentially-spaced vanes rotating within the chamber and mounted on the shaft, wherein the rotary airlocks may be jammed by lumps of solid rocks or other hard materials found in the coal, an improvement to each of the rotary airlocks, comprising:

means for continually monitoring an instantaneous motor current, and controller means electrically communicating with the motor for reversing the motor when the monitored instantaneous motor current exceeds a predetermined current value, thereby substantially immediately sensing an initial stage of the jamming and quickly clearing the rotary airlock, wherein the quick clearing is performed according to one of the following strategies: (1) the controller means reverses a direction of rotation of the vanes, (2) the controller means reverses a direction of rotation of the vanes for a short time, and then continues the rotation of the vanes in an original direction, and (3) the controller means reverses a direction of rotation of the vanes several times in momentary succession, and then continues the rotation of the vanes in an original direction, wherein the motor is a variable speed motor, wherein the controller means ramps up power to the motor from substantially zero to a final operating level in order to provide a soft start for reversing the motor, and wherein the predetermined current value of the motor comprises an average of a current value when the rotary airlock is unjammed and a current value when the rotary airlock is completely jammed and cannot rotate.

22. In a coal processing system, wherein coal particles are passed into and out of a processing vessel through a rotary airlock, the rotary airlock including a plurality of circumferentially-spaced vanes rotating within a chamber and mounted on a shaft driven by reversible electric motor externally of the chamber, the motor having a rated operating current, and wherein the rotary airlock is subject to jamming by lumps of solid rock or other hard materials found in the coal, thereby requiring a complete shut-down of the system to manually unclog the rotary airlock, a method for unjamming the rotary airlock, comprising the steps of:

continuous monitoring of an instantaneous motor current, comparing the instantaneous motor current with the rated operating current of the motor to obtain a differential signal, and reversing the motor when the differential signal has exceeded a predetermined threshold value, thereby quickly sensing when jamming may occur in the rotary airlock and clearing the rotary airlock.

23. The method of claim 22, wherein the controller means reverses the motor substantially immediately once the differential signal has exceeded the predetermined threshold value, thereby unjamming initial stages of a jam and avoiding the complete jam.

24. The method of claim 22, wherein the controller means triggers the motor to reverse the motor repeatedly until the rotary airlock is cleared of the jam.

25. The method of claim 22, wherein the motor has a variable speed capabilities, and wherein the controller means controls the variable speed capabilities to provide a soft start for reversing the motor.

26. The method of claim 25, wherein the controller means ramps up power to the motor from substantially zero to a final operating level in order to provide a soft start for reversing the motor.

27. The method of claim 22, wherein the controller means reverses the motor automatically.

28. The method of claim 22, wherein the controller means reverses a direction of rotation of the vanes are keeps a reversed direction until next jamming situation occurs.

29. The method of claim 22, wherein the controller means reverses a direction of rotation of the vanes for a short time, and then continues the rotation of the vanes in an original direction.

30. The method of claim 22, wherein the controller means reverses a direction of rotation of the vanes several times in momentary succession, and then continues the rotation of the vanes in an original direction.

31. The method of claim 22, wherein the predetermined threshold value comprises an average of a current value when the rotary airlock is unjammed and a current value when the rotary airlock is completely jammed and cannot rotate.

* * * * *